United States Patent [19]

Morrow

[11] 4,114,885

[45] Sep. 19, 1978

[54] THROWING DISC

[76] Inventor: Larry N. Morrow, 10616 Ravenscroft, Dallas, Tex. 75230

[21] Appl. No.: 749,471

[22] Filed: Dec. 10, 1976

[51] Int. Cl.[2] ..... A63H 27/00; A63B 65/10

[52] U.S. Cl. ..... 273/106 B

[58] Field of Search ..... 273/106 B, DIG. 8

[56] References Cited

U.S. PATENT DOCUMENTS

| | | | |
|---|---|---|---|
| 2,640,699 | 6/1953 | Garbo | 273/106 B |
| 3,710,505 | 1/1973 | Linenfelser | 273/106 B X |
| 3,802,704 | 4/1974 | Genua | 273/106 B X |

OTHER PUBLICATIONS

*Playthings* Catalog 5-1972, p. 38 Nerf Disc.

*Primary Examiner*—Paul E. Shapiro
*Attorney, Agent, or Firm*—Wendell Coffee

[57] ABSTRACT

A throwing disc is made of foamed resilient synthetic materials having a density of about 20 grams per liter. The disc is circular and with the diameter being about six times the thickness, and the disc being of uniform thickness and density. The circumferential edge may be beveled.

14 Claims, 7 Drawing Figures

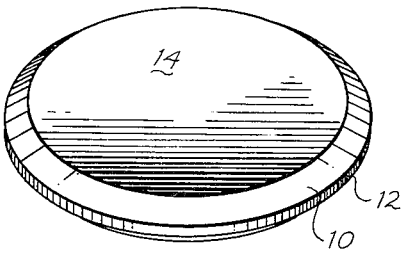
Fig. 1
Fig. 2
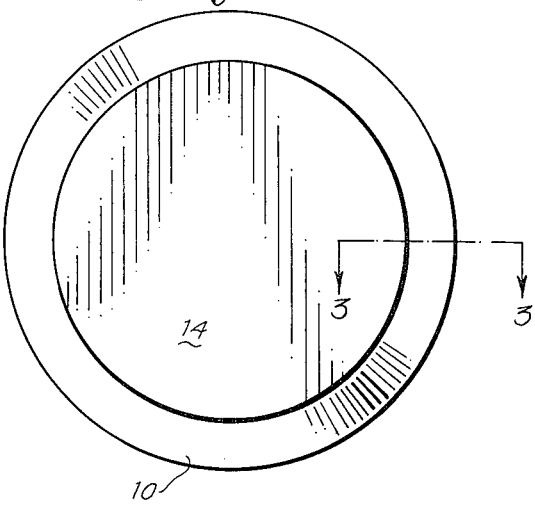
Fig. 3
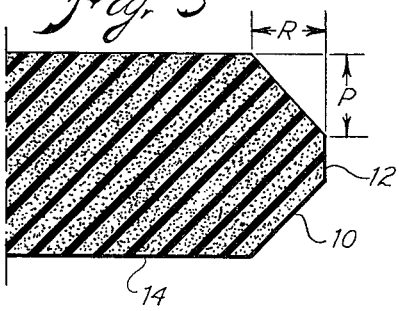
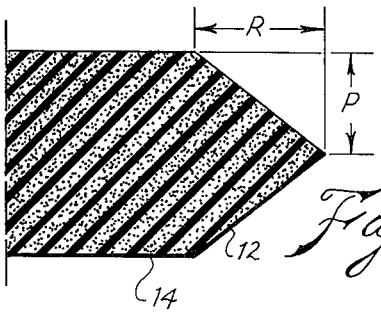
Fig. 4
Fig. 6
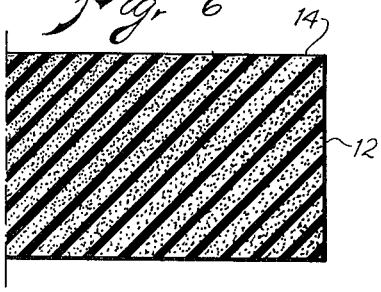
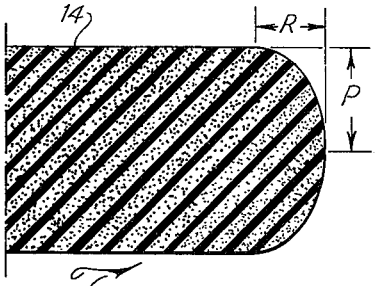
Fig. 5
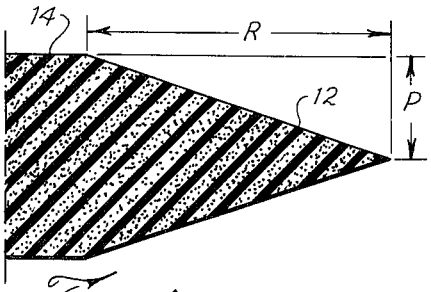
Fig. 7

THROWING DISC

BACKGROUND OF THE INVENTION

1. Field of the Invention

This invention relates to exercise devices and more particularly to throwing discs.

2. Description of the Prior Art

Throwing discs having domed radial faces and curved peripheral faces are commonly available and commonly known by the trademark FRISBEE. While having good aerodynamic qualities, they are not suitable for young children nor are they suitable for indoor use.

SUMMARY OF THE INVENTION

New and Different Function

I have discovered that a superior throwing disc can be made of foamed resilient synthetic materials, such as foamed polyurethane. I have discovered that very small children can "sail" such a disc. They cannot only throw such a disc, but they can catch such a disc, or even miss catching it, without harm to the child. Even if the child is hit full in the face by the disc, no harm is done.

In addition, I have found that such a disc can be readily used indoors.

Object of the Invention

An object of this invention is to provide a throwing disc.

Further objects are to achieve the above with a device that is sturdy, compact, durable, lightweight, simple, safe, and versatile, yet inexpensive and easy to manufacture and use.

The specific nature of the invention, as well as other objects, uses and advantages thereof, will clearly appear from the following description and from the accompanying drawing, the different views of which are not necessarily to the same scale.

BRIEF DESCRIPTION OF THE DRAWING

FIG. 1 is a perspective view of a throwing disc according to this invention.

FIG. 2 is an elevational view showing the radial face thereof.

FIG. 3 is a sectional view taken on line 3—3 of FIG. 2 showing the lip or peripheral face of a first embodiment.

FIG. 4 is a sectional view showing the lip or peripheral face of a second embodiment.

FIG. 5 is a sectional view showing the lip or peripheral face of a third embodiment.

FIG. 6 is a sectional view showing the lip or peripheral face of a fourth embodiment.

FIG. 7 is a sectional view showing the lip or peripheral face of a fifth embodiment.

DESCRIPTION OF THE PREFERRED EMBODIMENT

Referring more particularly to FIGS. 1 and 2, there may be seen that I have provided a throwing disc having a diameter of about 31 cm. I have had particularly good success using diameters from 30 cm to 32 cm, although variations from this may be made without materially affecting the throwing qualities.

By throwing qualities it will be understood that one of the major pleasures of this is to "sail" the disc, which means to spin it at a high rate of rotation with the leading edge slightly elevated so that it tends to rise and stall and then come backward slightly or settle vertically. However, I have found that it is highly desirable that the diameter be about six times the thickness. I.e., with the 31 cm diameter, I have found it is desirable to have 5 cm thickness.

I have had good results using a foam having a density of about 20 grams per liter (about 1.2 pounds per cubic foot). Therefore, a disc according to the preferred embodiment of my invention will have a weight of about 70 grams (2½ ounces). The preferred foam is known in the trade as "2 pound" foam and has an ILD of 32 to 35 (initial load deflection of 32 to 35 oz. per square inch).

Referring to the first embodiment, it may be seen that the peripheral face or edges are beveled at 10. This first embodiment shows the bevel to ba at 45° and having peripheral face 12 of about 10 mm. All embodiments of the disc are symmetrical, i.e., the two bevels adjacent to radial face 14 are equal. For example in the first embodiment, each of the bevels extends along a projection of the radial face a distance "R" of about 2 cm and also extends along a projected peripheral face a distance "P" of about 2 cm.

Obviously the throwing disc can be used for other activities. It forms a comfortable stadium seat as well as offering a pleasing pastime while walking to and from the stadium. Very young children, being inventive, find many uses for them.

Other peripheral edges are shown in FIGS. 4 through 7. However, in each instance I prefer to use a disc thickness of about 5 cm, a disc diameter of about 31 cm and a flat radial face 14.

Briefly describing each:

FIG. 4 shows peripheral face 12 of negligible millimeters, "P" of 25 mm and "R" of 32 mm.

FIG. 5 shows an arcuate edge with "R" equal 16 mm.

FIG. 6 shows a square peripheral edge.

FIG. 7 shows an edge with negligible peripheral face and "R" of 76 mm and "P" of 25mm.

The embodiments shown and described above are only exemplary. I do not claim to have invented all the parts, elements or steps described. Various modifications can be made in the construction, material, arrangement, and operation, and still be within the scope of my invention. The limits of the invention and the bounds of the patent protection are measured by and defined in the following claims. The restrictive description and drawing of the specific example above do not point out what an infringement of this patent would be, but are to enable the reader to make and use the invention.

I claim as my invention:

1. A throwing disc comprising:

a. a circular resilient disc of uniform thickness and density, b. the diameter being about six times the thickness, and c. the density being about 20 grams per liter.

2. The invention as defined in claim 1 wherein d. the diameter is about 31 cm and the thickness is about 5 cm.

3. The invention as defined in claim 1 with an additional limitation of d. the weight of the disc being about 70 grams.

4. The invention as defined in claim 1 wherein d. the circumference of the disc is beveled on both sides.

5. The invention as defined in claim 1 wherein d. the disc is beveled from both radial faces and there is a peripheral flat face.

6. The invention as defined in claim 5 wherein e. the bevel is about 45° and extends about 20 mm along the radial and peripheral face.

7. The invention as defined in claim 1 with an additional limitation of d. the disc is comprised of foamed polyurethane, known in the trade as "2 pound" foam.

8. The invention as defined in claim 1 with an additional limitation of d. the disc is comprised of foamed synthetic material.

9. The invention as defined in claim 8 wherein e. the circumference of the disc is beveled on both sides.

10. The invention as defined in claim 9 with an additional limitation of f. the weight of the disc being about 70 grams.

11. The invention as defined in claim 10 wherein g. there is a peripheral flate face between the bevels.

12. The invention as defined in claim 11 wherein h. the diameter is about 31 cm and the thickness is about 5 cm.

13. The invention as defined in claim 12 wherein j. the bevel is at about 45° and extends about 20 mm along the radial and peripheral face.

14. The invention as defined in claim 13 with an additional limitation of k. the synthetic material is polyurethane, known in the trade as "2 pound" foam having an ILD of 32 to 35.

* * * * *